US005245350A

United States Patent [19]

Sroka

[11] Patent Number: 5,245,350

[45] Date of Patent: Sep. 14, 1993

[54] RETRACTABLE ANTENNA ASSEMBLY WITH RETRACTION INACTIVATION

[75] Inventor: Peter Sroka, Sandhurst, England

[73] Assignee: Nokia Mobile Phones (U.K.) Limited, Surrey, England

[21] Appl. No.: 908,229

[22] Filed: Jul. 2, 1992

[30] Foreign Application Priority Data

Jul. 13, 1991 [GB] United Kingdom ..... 9115137

[51] Int. Cl.[5] ..... H01Q 1/24

[52] U.S. Cl. ..... 343/702; 343/725; 343/901

[58] Field of Search ..... 343/702, 900, 901, 725, 343/729, 846, 715

[56] References Cited

U.S. PATENT DOCUMENTS

| | | | |
|---|---|---|---|
| 3,087,117 | 4/1963 | Mitchell | 325/118 |
| 4,829,591 | 5/1989 | Hashimoto et al. | 455/89 |
| 4,920,352 | 4/1990 | Martensson et al. | 343/702 |
| 4,989,012 | 1/1991 | Martensson et al. | 343/702 |
| 5,057,848 | 10/1991 | Rankin et al. | 343/725 |
| 5,072,230 | 12/1991 | Taniyoshi et al. | 343/903 |

FOREIGN PATENT DOCUMENTS

| | | |
|---|---|---|
| 0359361A1 | 3/1990 | European Pat. Off. . |
| 0415703 | 3/1991 | European Pat. Off. . |
| 828213 | 2/1960 | United Kingdom . |
| 1507076 | 4/1978 | United Kingdom . |
| 2185634A | 7/1987 | United Kingdom . |
| 2185635A | 7/1987 | United Kingdom . |
| 2219911 | 12/1989 | United Kingdom . |

*Primary Examiner*—Rolf Hille
*Assistant Examiner*—Hoanganh Le
*Attorney, Agent, or Firm*—Perman & Green

[57] ABSTRACT

An antenna assembly comprises an elongate radiating element (11) movable between a retracted position and an extended position, and a substantially planar radiating element (12) extending transversely to the elongate element. The elongate element extends through an aperture (25) in the planar element. A pair of concentric conductors (9,10) provide coaxial feed to the radiating elements and the elongate element is slidably mounted within the inner conductor (9). In the retracted position the elongate element forms part of the coaxial feed to the planar element and is itself rendered inoperative as a radiator. The invention provides a compact and convenient dual antenna arrangement ideally suited for use in a portable cellular radio telephone.

14 Claims, 1 Drawing Sheet

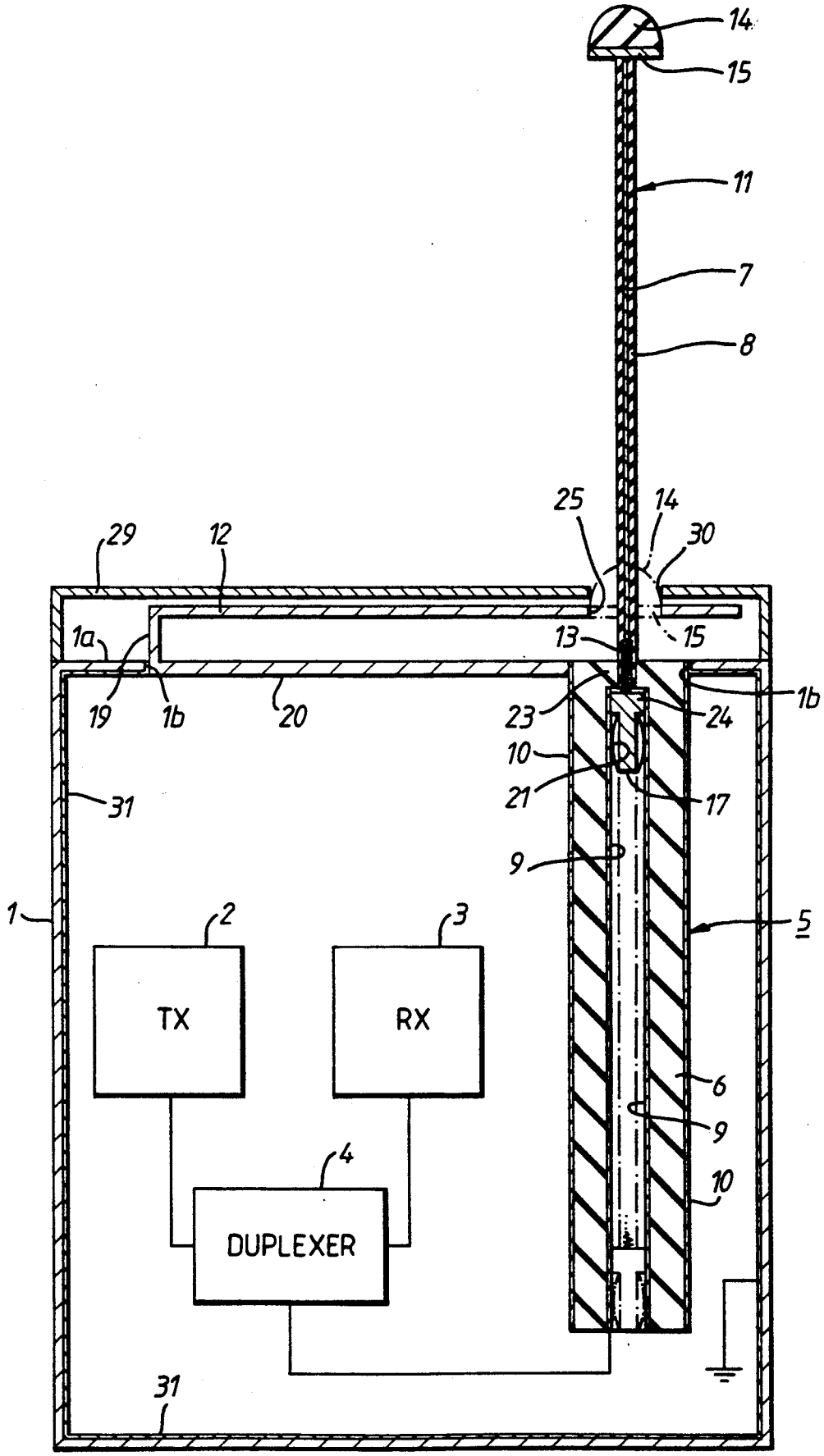
14
15
11
7
8
25
14
30
29
12
1a
13
15
19
1b
20
23
24
1b
10
21
17
31
9
1
2
3
5
TX
RX
6
9
4
10
DUPLEXER
31

RETRACTABLE ANTENNA ASSEMBLY WITH RETRACTION INACTIVATION

This invention relates to an antenna assembly comprising a retractable antenna which may be applied, for example, to a portable radio and, in particular a hand portable radio telephone.

BACKGROUND OF THE INVENTION

A radio intended for two-way communication generally operates with either an external fixed rod or retractable antenna, or with an internal antenna. The fixed rod type of antenna has a predetermined length. Whilst such antennas can be relatively short, they are not conducive to a compact design nor are they particularly suitable for a radio intended to be carried in a pocket or other receptacle offering restricted space. On the other hand, retractable antennas are convenient for this purpose because they can be folded away when the radio is not in use. Retractable antennas are commonly of the telescopic tube type, although retractable fixed length antennas are also known.

Some known portable radios such as that disclosed in U.S. Pat. No. 3,087,117 have two antennas, i.e. an internal element together with a retractable element, and are also equipped with means for automatically switching between the two elements according to the physical position of the retractable element. Hence the retractable antenna is operable in the extended position, while the internal antenna element becomes operable when the retractable element is in the retracted position.

An important consideration with a dual antenna system is that both antennas should provide efficient operation under different conditions as appropriate. For example, while the external antenna element may provide better sensitivity and range performance during normal use, the less efficient internal antenna must provide satisfactory performance during stand-by operation.

U.S. Pat. No. 4,868,576 discloses an antenna for a portable cellular telephone comprising a helical coil at the base of a retractable elongate radiating element. The retractable element, which extends through the helical coil, has non-conductive portions at its two ends whereby in the extended position the elongate element is capacitively coupled to the helical coil, and in the retracted position the elongate element is substantially decoupled therefrom. The helical coil is fixedly mounted on the housing of the radio transceiver.

SUMMARY OF THE INVENTION

According to the present invention there is provided an antenna assembly comprising an elongate radiating means movable between a retracted position and an extended position, and a substantially planar radiating means extending transversely to the elongate radiating means, the elongate radiating means extending through said planar radiating means in the extended position, wherein the elongate radiating means is rendered inactive by movement to the retracted position.

An antenna assembly in accordance with the present invention provides a compact and convenient dual antenna arrangement which is ideally suited for portable radio applications and which can be manufactured and assembled in a relatively straightforward manner and therefore at low cost. In the extended position the elongate radiating means are active, and in the retracted position the elongate radiating means are rendered inactive so that the more compact planar radiating means alone may perform the radiating function.

A pair of substantially concentric conductors are suitably included which provide coaxial feed means to the respective radiating means. In the retracted position the elongate radiating means suitably constitutes at least part of the coaxial feed means to the planar radiating means.

In a preferred embodiment the elongate radiating means is slidably mounted in a support, the concentric conductors being provided on the support. The support may, for example, comprise a dielectric tube (not necessarily circular in cross-section) with the concentric conductors being provided respectively on the internal and external faces thereof. Alternatively, the concentric conductors may be formed as a pair of self-supporting concentric cylinders (again not necessarily circular in cross-section) spaced apart by an air gap. In either case the elongate antenna radiating means may be slidably mounted within the inner conductor such that an electrically conductive part, preferably at the inner end thereof, physically contacts, and so is electrically coupled to, the inner conductor of the concentric pair of conductors.

In the preferred embodiment coupling means are also provided at the outer end of the elongate radiating means which electrically couple the planar radiating means to the central conductor of the concentric pair of conductors when the elongate radiating means is in the retracted position. Either direct or capacitive coupling may be used. In the former case the contact means would physically and electrically contact the planar radiating means whereas in the later case an intermediate dielectric (or other insulator) may be present. In either case the planar radiating means is automatically coupled to the coaxial feed means when the elongate radiating means is in the retracted position. The contact means may be in the form of a flange extending transversely to the elongate radiating means.

Suitably the planar radiating means, which may for example form part of an antenna of the so-called planar inverted F (PIF) type, comprises an aperture complementary to the flange, wherein the flange is accommodated in said aperture in such manner that the flange is electrically coupled to the planar radiating means when the elongate radiating means is in the retracted position. In the extended position the elongate radiating means extends through the aperture in the planar radiating means.

BRIEF DESCRIPTION OF THE DRAWINGS

An embodiment of the invention will now be described, by way of example, with reference to the accompanying drawings in which:

The single FIGURE is a schematic cross-section of a portable cellular radio telephone incorporating an antenna assembly in accordance with the present invention, showing the antenna in the extended position.

DETAILED DESCRIPTION OF THE INVENTION

It is noted that for the sake of clarity the FIGURE is not drawn to scale.

The portable cellular radio telephone shown in the FIGURES comprises a main housing 1 made, for example, of an insulating plastics material. A layer of metallization 31 connected to ground potential is provided on the internal faces of the housing 1. The housing 1 encloses a conventional transmitter 2 and receiver 3 coupled respectively via a duplexer 4 to the inner conductor 9 of the coaxial feed to the antenna assembly. The coaxial feed and antenna assembly will be discussed in more detail below.

The main housing 1 also encloses all the other features conventionally found in a portable cellular telephone. Since these aspects are not directly relevant to the instant invention no further details will be given here.

The antenna assembly, provided adjacent the top face 1*a* of the main radio housing 1, comprises a support 5 in the form of a dielectric cylindrical tube 6. The upper end of the dielectric tube extends into an aperture 1*b* in the top face 1*a* of the main housing 1. The dielectric material of the tube 6 may, for example, be polytetrafluoroethylene (PTFE) or polyethylene.

The bore of the dielectric tube 6 is provided with a conductive coating 9, for example of nickel plated copper. A conductive coating 10, for example of copper, is also provided on the outer face of the tube 6. The inner and outer conductive coatings 9 and 10 are electrically isolated from each other. The outer conductor 10 is electrically connected to ground potential. To this end the upper end of the support 5 abuts the internal edge of the aperture 1*b* in the top face 1*a* of the main housing 1 so that the outer conductor 10 electrically contacts the ground metallization 31 on the internal faces of the housing 1. To ensure good electrical contact the metallization 31 may extend onto the internal edge of the aperture 1*b*. The support 5 constitutes a coaxial feed to the antenna elements which will now be described.

The antenna assembly comprises two distinct radiating elements, namely an elongate antenna element 11 and a plate-like element 12. The elongate element 11 comprises a central conductor 7 which may be a solid rod antenna or, alternatively, may be in the form of a close-wound coil which not only enhances flexibility of the elongate element and so reduces the risk of breakage, but also reduces the physical length of the antenna. The coil may be made of silver plated beryllium-copper wire. The elongate antenna element 11 may be chosen to have an equivalent electrical length, for example, of a quarter-wavelength or three-eights wavelength. The conducting portion 7 of the elongate element 11 is enclosed within an insulating sleeve 8 made for example of a flexible plastics material. At the base of the elongate antenna element there is provided an impedance matching inductor 13 having one end connected to the conductor 7 of the elongate antenna element Il and the other end connected to an electrically conductive end portion 17 which is in electrical contact with the inner conductor 9 of the dielectric tube 6 (see FIG. 3). The inductor 13 is present within the insulating sleeve 8. A radially biassed phosphor bronze spring 21 surrounding the end portion 17 bears against the inner conductor 9 of the support 5 for optimal electrical contact therewith.

The elongate antenna element 11 is slidably mounted in the bore of the dielectric tube 6 and the conductive spring 21 remains in electrical contact with the inner conductor 9 at all times. The elongate antenna element 11 thus constitutes the radiating element of a retractable monopole antenna.

A conductive disc-shaped flange 15 is provided at the end of the elongate antenna element 11 remote from the support 5. The flange 15 is electrically connected to the conducting portion 7 of the monopole element 11. A tab 14, made for example of an insulating material, is provided on the outward face of flange 15. The tab 14, which may be of any suitable shape, provides a convenient feature for the user to grip when extending or retracting the antenna.

The plate-like radiating element 12 which is substantially planar and has a generally rectangular outline is provided within an insulating lid 29 attached to the main housing 1 adjacent the top face 1*a* thereof. The lid 29 encloses the plate 12 to provide mechanical protection therefor and to make the visual appearance of the telephone more aesthetically pleasing. The dimensions of the plate-like element 12 are chosen so that the length of the perimeter thereof is substantially equal to a half wavelength. The aspect ratio is selected according to the desired bandwith requirements. For example, for operation at 1 GHz the length of the plate 12 (i.e. the dimensions depicted in the FIGURE) may be 6 cm and the width may be 2 cm.

The plate 12 is coupled via an upstanding conductive portion 19 to a further substantially planar conductive member 20 forming a ground plane spaced apart and parallel to the planar radiating element 12. The spacing between the plate 12 and ground plane 20 is chosen to give the appropriate bandwith and impedance.

The space between the plate 12 and the ground plane 20 may be filled with a low permittivity dielectric material such as, for example, polyethylene or polyethylentetrafluoride (PTFE).

The ground plane conductor 20 extends as far as the support 5 and is in electrical contact with the outer grounded conductor 10 thereon. Moreover, the ground plane conductor 20 fits intimately within the complementary aperture 1*b* in the top face 1*a* of the main housing 1 and is thereby also in electrical contact with the grounded metallization 31 provided on the internal faces of the housing 1. To ensure good electrical contact the metallization 31 may extend onto the internal edge of the aperture 1*b*.

The plate-like radiating element 12 comprises a circular aperture 25 and the lid member 29 comprises a similar aperture 30 both disposed directly above the support 5, through which aperture the monopole antenna element 11 extends. The size and shape of at least the aperture 25 in the plate 12 are complementary to the flange 15 for reasons which are discussed in more detail below. On the other hand, the aperture 30 in the lid may be the same or longer than the flange 15.

It will be evident to a person skilled in the art that the plate antenna element 12 forms part of an antenna of the so-called planar inverted F (PIF) type.

When the monopole antenna 11 is fully extended, i.e. in the position shown in a solid line in the FIGURE, the electrically conductive end portion 17, which is coupled to the lower end of the impedance matching inductor 13, makes electrical contact via the conductive spring 21 with the inner conductor 9 of the support 5. The support 5 thus acts as a coaxial feed to the elongate radiating element 11. As mentioned previously, the inner conductor 9 on the dielectric tube 6 is coupled to the radio transmitter 2 and receiver 3 via the duplexer 4.

The dielectric tube has a projection 23 extending into the bore to provide a narrower diameter portion at the top end thereof. The elongate antenna element is provided with an outwardly extending flange 24 between the inductor 13 and the end portion 17. The flange 24 on the antenna element 11 abuts the projection 23 on the support 5 when the antenna is fully extended and this acts as a stop to prevent further withdrawal of the antenna.

When the antenna 11 is fully extended the inductor 13 is disposed at least partially within the support 5, so that there will be some stray capacitance between the inductor 13 and the outer conductor 10 on the support 5. The inductor 13 together with this stray capacitive effect constitute an impedance matching network for the elongate antenna 11.

In the retracted position, shown by the broken line in the FIGURE, the flange 15 at the outer end of the elongate antenna element 11 fits into the aperture 25 of the plate antenna 12 in such manner as to make an intimate electrical DC continuous connection therewith. The conductive end portion 17 of the elongate element 11 remains in electrical contact via conductive spring 21 with the inner conductor 9. The elongate antenna element thus essentially becomes a part of the coaxial feed coupled directly to the plate antenna 12. Since the elongate antenna element is substantially enclosed by conductive material it is itself rendered inactive as a radiator. Thus the contact means for connecting the plate antenna in place of the elongate element form an integral part of the elongate element itself, and no further switching mechanism is required.

In a modification of the present embodiment the flange 15 may be surrounded by an annulus of dielectric or other insulating material and/or the aperture 25 in the plate antenna 12 may be lined with a bush made of dielectric or other insulating material in order to provide capacitive coupling (rather than a DC continuous connection) between the plate antenna 12 and the flange 15. Alternatively capacitive coupling between the plate antenna 12 and the flange 15 may be provided by an air gap, or even an interference fit, between the flange 15 and the plate antenna 12 when the elongate antenna element 11 is retracted.

A detent feature (not shown), for example a projecting portion, may be provided in the bore of the dielectric tube 6 at the lower end thereof, against which the flange 24 at the base of the antenna element 11 abuts when the antenna is fully retracted and this acts as a stop to limit the retraction of the antenna and so define the fully retracted position.

In a modification of the present embodiment a further inductor may also be provided towards the outer end of the elongate antenna 11 such that when the elongate antenna is fully retracted the further inductor adopts a position corresponding to that of inductor 13 when the antenna is fully extended, i.e. as illustrated in the FIGURE. The further inductor and the stray capacitance between the inductor and the outer conductor 10 on the support 5 together provide an impedance matching network for the PIF antenna which will become effective automatically when the elongate antenna element is retracted.

It is noted here that the characteristic impedance $Z_o$ of the respective transmission lines which feed the elongate antenna element 11 and the plate antenna element 12 when the elongate antenna element is respectively extended and retracted is substantially the same despite the different nature of the central conductor in the two cases. This is because, in the case of a coaxial transmission line with a circular cross-section, $Z_o$ is determined by the equation $$Z_o = \frac{60}{\sqrt{(\epsilon_r)}} \ln (d_o/d_i)$$

where $\epsilon_r$ is the relative permittivity of the dielectric material of tube 6, $d_o$ is the diameter of the outer conductor of the coaxial feed, and $d_i$ is the diameter of the inner conductor of the coaxial pair. Clearly $\epsilon_r$, and $d_o$ do not change between the extended and retracted positions. More significantly, however, it will be seen that with the present arrangement $d_i$ does not change since the overall diameter of the central conductor 9 is constant and is not altered by the action of the elongate antenna element 11 sliding internally within the inner conductor 9.

In view of the foregoing description it will be evident to a person skilled in the art that various modifications may be made within the scope of the present invention. For example, instead of being formed of a solid dielectric tube the antenna support may comprise a pair of concentric metal cylinders held in spaced relationship by insulating spacers. In this case the dielectric may be air in the gap between the concentric cylinders. Furthermore, it is noted here that neither the dielectric tube and the bore thereof, nor the concentric metal cylinders need be circular in cross-section, but may instead be square, rectangular, oval, or indeed any other suitable shape. Similarly, the plate-like radiating element is not limited to the rectangular configuration described above but may, for example, be square, L-shaped, circular, oval or any other suitable outline. Also the flange at the outer end of the elongate antenna, and the apertures in the housing lid and plate-like radiating element may have any suitable complementary shape.

I claim:

1. An antenna assembly comprising an elongate radiating means movable between a retracted position and an extended position, a substantially planar radiating means extending transversely to the elongate radiating means, the elongate radiating means extending through said planar radiating means when the elongate radiating means is in the extended position, wherein the elongate radiating means is rendered inactive by movement to the retracted position, a pair of substantially concentric conductors adapted to provide coaxial feed means to said elongate radiating means and said planar radiating means, and coupling means which electrically couple the planar radiating means to the central conductor of the concentric pair of conductors when the elongate radiating means is in the retracted position.

2. An antenna assembly as claimed in claim 1, wherein the elongate radiating means, in the retracted position, constitutes at least part of the coaxial feed means to the planar radiating means.

3. An antenna assembly as claimed in claim 1, wherein the elongate radiating means is slidably mounted within the inner conductor of the concentric pair of conductors.

4. An antenna assembly as claimed in claim 1, wherein the elongate radiating means is slidably mounted in a support, the concentric conductors being provided on said support.

5. An antenna assembly as claimed in claim 1, wherein means are provided at one end of the elongate radiating means which electrically couple said one end of the elongate radiating means to the inner conductor of the concentric pair of conductors.

6. An antenna assembly as claimed in claim 5, wherein said coupling means which couple the planar radiating means to the central conductor is provided at the other end of said elongate radiating means.

7. An antenna assembly as claimed in claim 6, wherein the coupling means at the other end of said elongate radiating means is in the form of a flange extending transversely to the elongate radiating means.

8. An antenna assembly as claimed in claim 7, wherein the planar radiating means comprises an aperture complementary to said flange, the flange being accommodated in said aperture so as to be electrically coupled to said planar radiating means when the elongate radiating means is in the retracted position, and the elongate radiating means extends through said aperture in the planar radiating means when the elongate radiating means is in the extended position.

9. An antenna assembly as claimed in claim 1, wherein the planar radiating means form part of an antenna of the planar inverted F type.

10. An antenna assembly as claimed in claim 1 including impedance matching means associated with said elongate radiating means.

11. An antenna assembly as claimed in claim 10, including further impedance matching means associated with said planar radiating means, said further impedance matching means being rendered effective by movement of the elongate radiating means to the retracted position.

12. An antenna assembly as claimed in claim 1, wherein the coupling means is present on the elongate radiating means.

13. An antenna assembly as claimed in claim 12, wherein the coupling means is in the form of a flange extending transversely to the elongate radiating means.

14. A portable radio transceiver comprising:

a housing enclosing transmitting and receiver circuitry; and an antenna assembly comprising an elongate radiating means movable between a retracted position and an extended position, a substantially planar radiating means extending transversely to the elongate radiating means, the elongate radiating means extending through said planar radiating means when the elongate radiating means is in the extended position, wherein the elongate radiating means is rendered inactive by movement to the retracted position, a pair of substantially concentric conditions adapted to provide coaxial feed means to said elongate and planar radiating means, and coupling means which electrically couple the planar radiating means to the central conductor of the concentric pair of conductors when the elongate radiating means is in the retracted position, said antenna assembly being coupled to said transmitting and receiving circuitry.

* * * * *